US005464351A

United States Patent [19]

Oka

[11] Patent Number: 5,464,351

[45] Date of Patent: Nov. 7, 1995

[54] BRANCH JOINT BOX

[75] Inventor: Tatsuya Oka, Yokkaichi, Japan

[73] Assignee: Sumitomo Wiring Systems, Ltd., Yokkaichi, Japan

[21] Appl. No.: 226,300

[22] Filed: Apr. 12, 1994

[30] Foreign Application Priority Data

May 24, 1993 [JP] Japan ..... 5-027087 U

[51] Int. Cl.[6] ..... H01R 13/62

[52] U.S. Cl. ..... 439/372; 439/144

[58] Field of Search ..... 439/133, 142, 439/143, 144, 299, 300, 345, 347, 352, 372, 488, 489

[56] References Cited

U.S. PATENT DOCUMENTS 4,878,853 11/1989 Yamade et al. .
4,884,978 12/1989 Inaba et al. .
5,017,147 5/1991 Sugiyama et al. .
5,174,785 12/1992 Endo et al. .

FOREIGN PATENT DOCUMENTS 0483853 5/1992 European Pat. Off. .
2264593 9/1993 United Kingdom .

OTHER PUBLICATIONS

United Kingdom Search Report.

*Primary Examiner*—Khiem Nguyen
*Attorney, Agent, or Firm*—Sandler, Greenblum, & Bernstein

[57] ABSTRACT

A branch joint box in which after a female connector connected to a wiring harness has been fitted into a male connector provided on the branch joint box, a lock cover provided on the branch joint box is closed and the female connector is locked to the male connector at a fitting position of the female connector by a locking portion of the lock cover, comprising: a temporary retention member for temporarily retaining the lock cover to the branch joint box at a closed position of the lock cover prior to fitting of the female connector into the male connector; a temporary retention cancelling member for cancelling temporary retention of the lock cover in response to fitting action of the female connector into the male connector so as to set the lock cover to an open position of the lock cover; and a fixed retention member which, after the female connector has been fitted into the male connector, not only locks the female connector to the male connector but locks the lock cover to the branch joint box.

4 Claims, 6 Drawing Sheets

BRANCH JOINT BOX

BACKGROUND OF THE INVENTION

The present invention relates to a branch joint box into which connectors of a wiring harness for a motor vehicle are inserted for connection so as to join a circuit by branching.

In a branch joint box used for joining a wiring harness for a motor vehicle to various electrical parts by branching, branch joint points are concentrated at one spot so as to reasonably and economically join a circuit by branching. In response to rise of density of wires of the wiring harness, various types of branch joint boxes have been developed.

In one of these known branch joint boxes, in case the branch joint box is assembled by preliminarily incorporating a male connector into the branch joint box and a female connector connected to a wiring harness is coupled with the male connector at an assembly line of motor vehicles, a lock cover for effecting double locking of the male and female connectors is mounted on the branch joint box in advance at an assembly line of branch joint boxes.

It is to be noted that the terms "male connector" and "female connector" are, respectively, used in this specification to mean a "connector having male terminals" and a "connector having female terminals" irrespective of their configurations.

For example, as shown in FIG. 1, a pair of dovetails 3*a* provided on opposite side faces of a unit 3 having a male connector 2 are, respectively, inserted from below into a pair of dovetail grooves 1*b* formed on opposite sides of a hollow 1*a* of a branch joint box 1 and a boss 3*b* provided on a rear face of the unit 3 as shown in FIG. 2 is brought into engagement with a slot 1*c* of a rear wall of the hollow la of the branch joint box 1 such that the unit 3 is secured to the branch joint box 1. Meanwhile, a lock cover 4 is provided on the unit 3 so as to be opened and closed through a thin hinge portion 4*a* integrally molded with the lock cover 4 as shown in FIG. 2.

As shown in FIG. 3, a dummy cover connector 5 is fitted into the male connector 2 of the unit 3 so as not to be closed during transport, etc. of the branch joint box 1 prior to mounting of the branch joint box 1 on a motor vehicle. At this time, in order to hold the lock cover 4 at an open position, not only a front face of the dummy cover connector 5 is brought into contact with a locking projection 4*b* of the lock cover 4 so as to retain the locking projection 4*b* but a hooked piece 3*c* of the unit 3 is brought into engagement with a recess 4c of the lock cover 4.

The branch joint box 1 is assembled in the above described state. Thus, when the branch joint box 1 is mounted on a motor vehicle, the dummy cover connector 5 is drawn out of the male connector 2 and then, a female connector 7 connected to a wiring harness 6 is fitted into the male connector 2. Subsequently, when the lock cover 4 is pushed to a closed position, the locking projection 4*b* of the lock cover 4 is brought into engagement with a recess 7*a* of the female connector 7 as shown in FIG. 2 so as to lock the female connector 7 at the fitting position. At the same time, a hooked piece 4*d* of the lock cover 4 is brought into engagement with a recess 3*d* so as to hold the lock cover 4 at a closed position.

However, in the above described arrangement of the known branch joint box 1, since the dummy cover connector 5 is required to be provided additionally, the number of components increases, thereby resulting in increase of the number of control steps of the components. Meanwhile, since the female connector 7 cannot be fitted into the male connector 2 unless the dummy cover connector 5 is drawn out of the male connector 2, the number of operational steps increases. Furthermore, there is such a risk that the lock cover 4 is closed inadvertently before the female connector 7 is fitted into the male connector 2 after the dummy cover connector 5 has been drawn out of the male connector 2. In this case, the lock cover 4 should be opened by using a jig.

Accordingly, an essential object of the present invention is to provide, with a view to eliminating the above described drawbacks of conventional branch joint boxes, a branch joint box in which a dummy cover connector is not required to be provided and a female connector can be fitted into a male connector regardless of whether a lock cover is disposed at an open position or a closed position.

In order to accomplish this object of the present invention, a branch joint box in which after a female connector connected to a wiring harness has been fitted into a male connector provided on the branch joint box, a lock cover provided on the branch joint box is closed and the female connector is locked to the male connector at a fitting position of the female connector by a locking portion of the lock cover, according to the present invention comprises: a temporary retention means for temporarily retaining the lock cover to the branch joint box at a closed position of the lock cover prior to fitting of the female connector into the male connector; a temporary retention cancelling means for cancelling temporary retention of the lock cover in response to fitting action of the female connector into the male connector so as to set the lock cover to an open position of the lock cover, and a fixed retention means which, after the female connector has been fitted into the male connector, not only locks the female connector to the male connector but locks the lock cover to the branch joint box.

In the present invention, the lock cover is temporarily retained to the branch joint box at the closed position preliminarily. Then, when the female connector is fitted into the male connector at an assembly line of motor vehicles, temporary retention of the lock cover is cancelled by fitting action of the female connector into the male connector such that the lock cover is automatically opened to the open position. Subsequently, when the lock cover is pushed to the closed position, not only the female connector is locked to the male connector at the fitting position by the locking portion of the lock cover but the lock cover is held at the closed position relative to the branch joint box.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
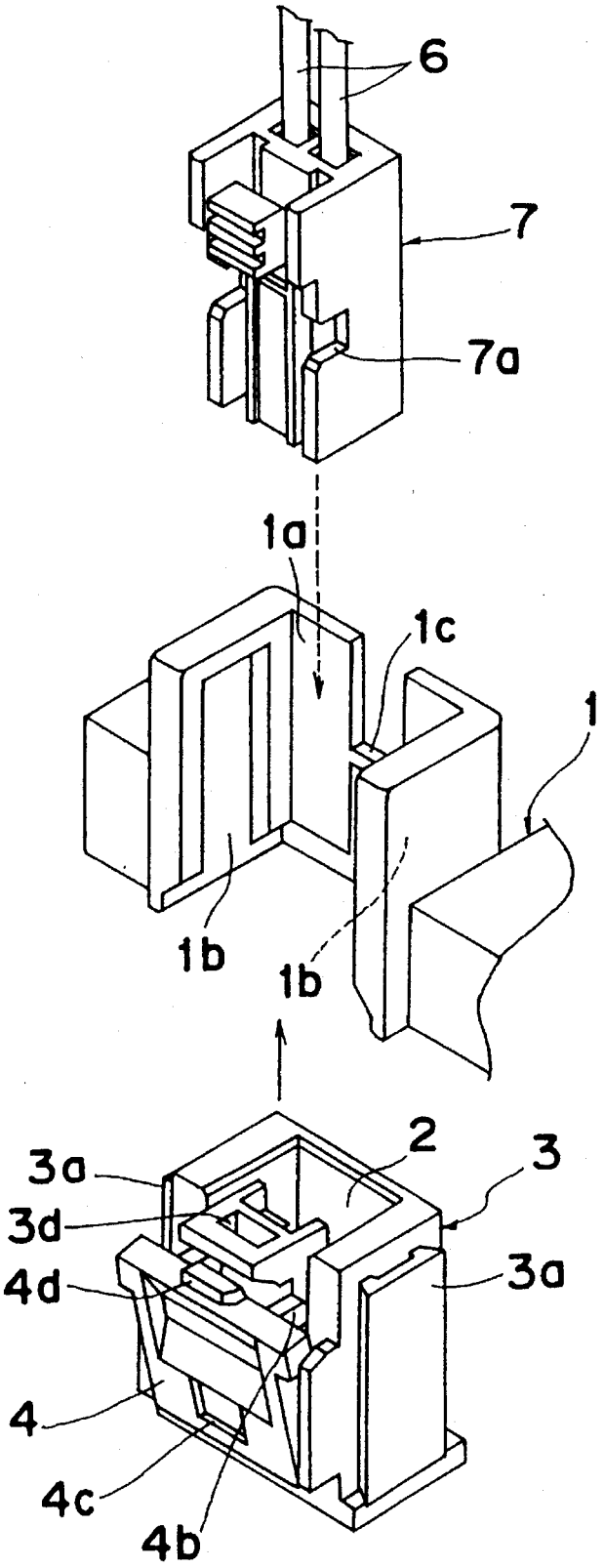
Fig. 1 PRIOR ART
FIG. 1 is an exploded perspective view of a prior art branch joint box (already referred to)
Figure 2:
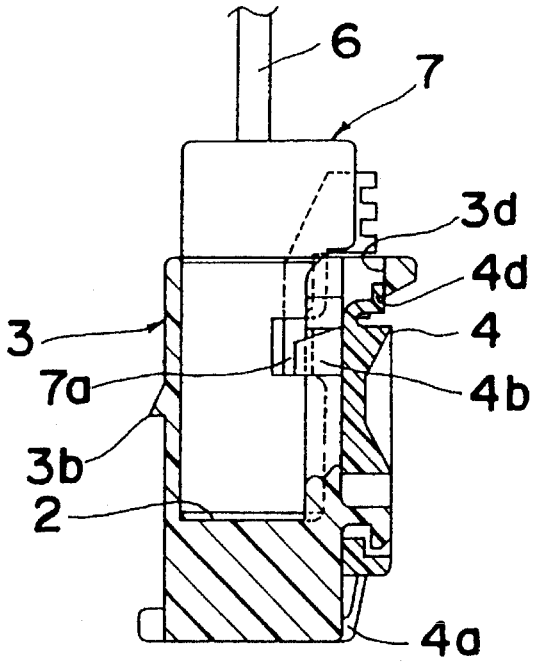
Fig. 2 PRIOR ART
FIG. 2 is a side sectional view of the prior art branch joint box of FIG. 1, in which a a female connector is fitted into a male connector (already referred to)
Figure 3:
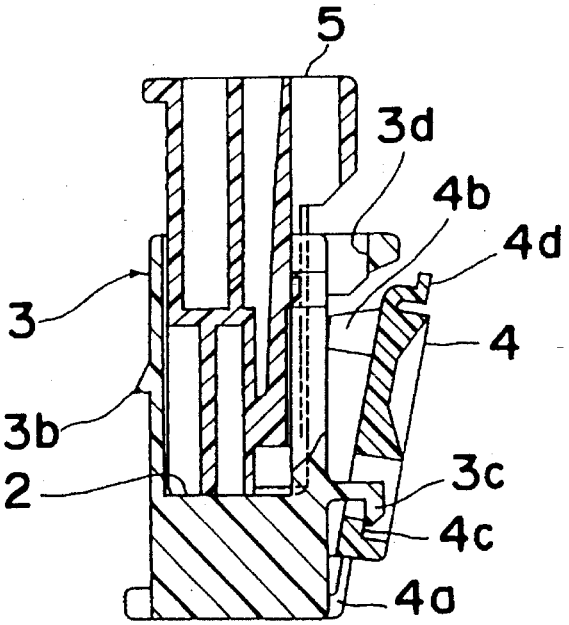
Fig. 3 PRIOR ART
FIG. 3 is a side sectional view of the prior art branch joint box of FIG. 1, in which a dummy cover connector is fitted into the male connector (already referred to)
Figure 8:
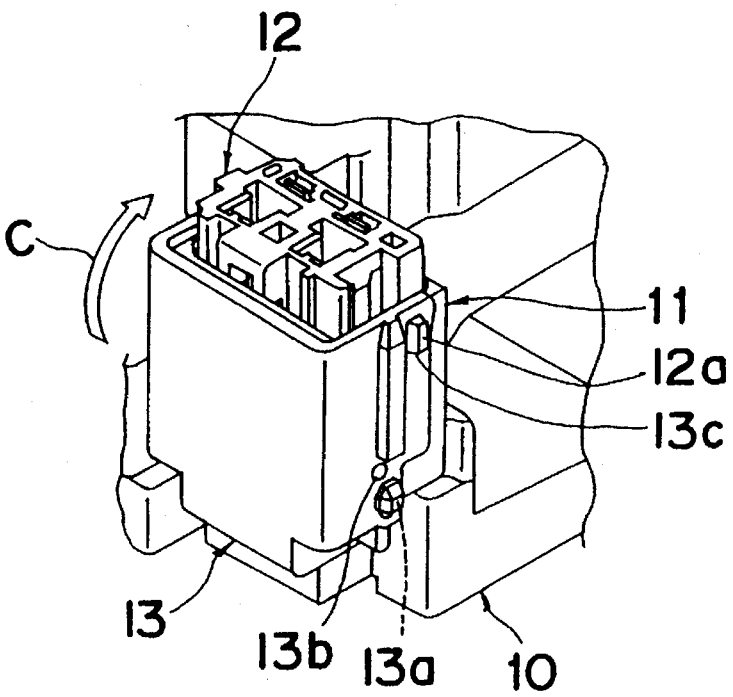
FIGS. 8 and 9 are a perspective view and a side elevational view of the branch joint box of FIG. 4 at the time of completion of fitting of the female connector into the male connector, respectively.
Figure 9:
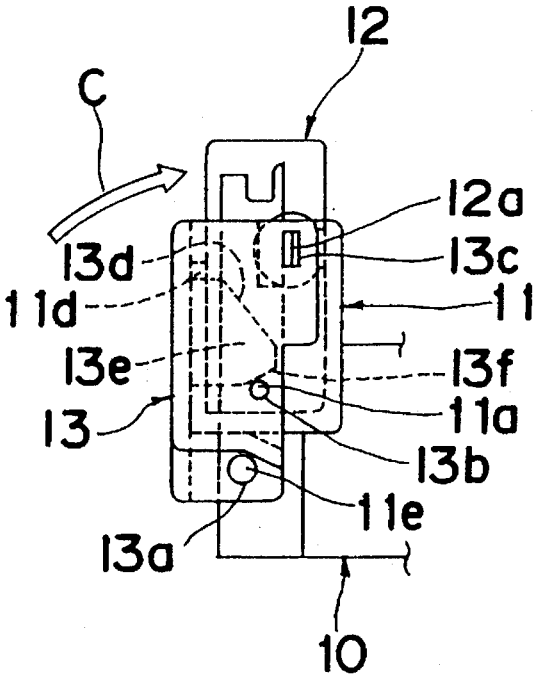
Figure 10:
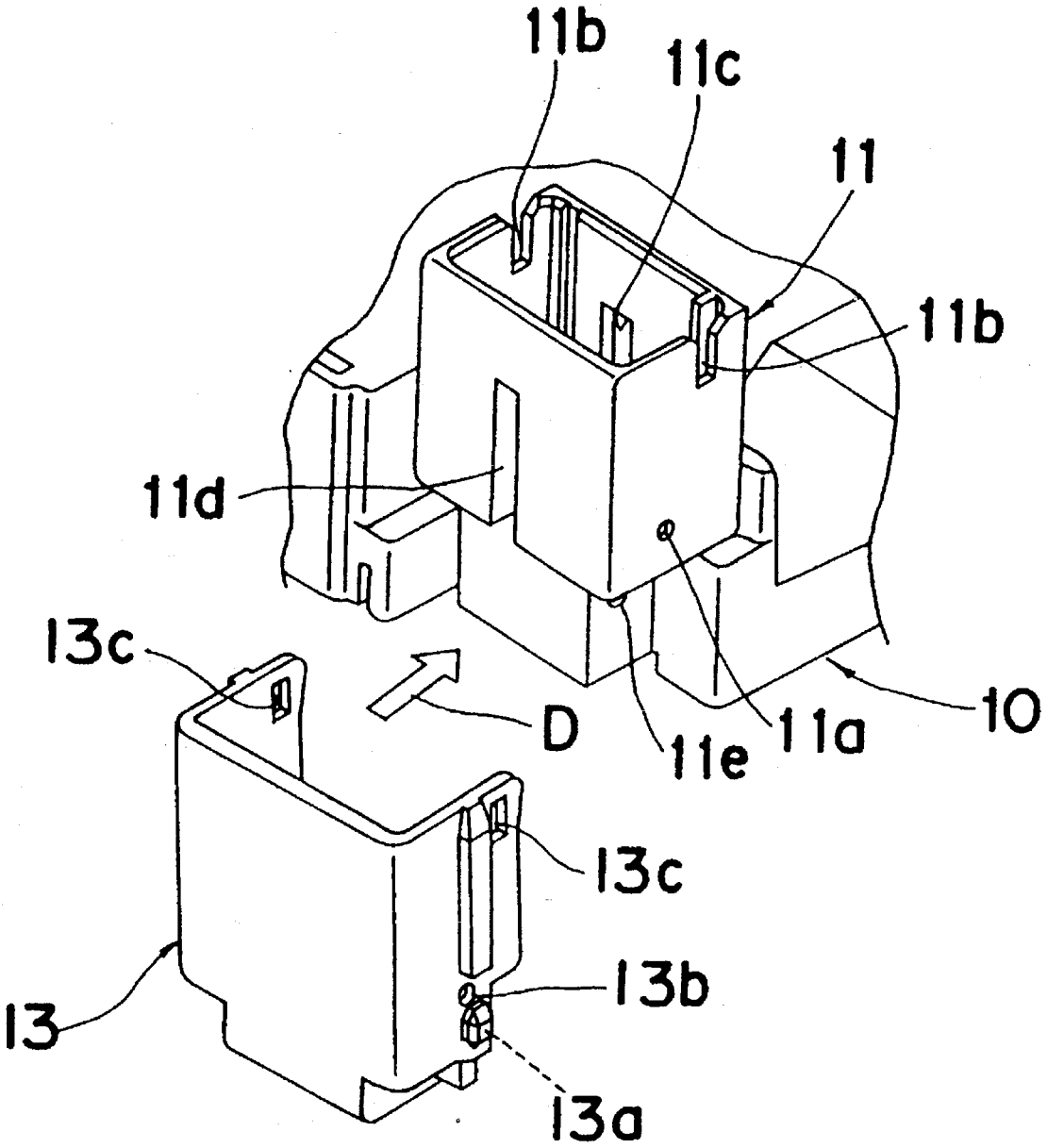
FIG. 10 is an exploded perspective view of the male connector and a lock cover in the branch joint box of FIG. 1.

Referring now to the drawings, there is shown in FIGS. 4 to 10, a branch joint box 10 according to one embodiment of the present invention. In contrast with a conventional arrangement in which a unit 3 having a male connector 2 is secured to a branch joint box 1 as shown in FIG. 1, a male connector 11 is integrally molded with the branch joint box 10 as shown in FIG. 10. A lock cover 13 is mounted on the male connector 11 at an assembly line of branch joint boxes, while a female connector 12 is fitted into the male connector 11 at an assembly line of motor vehicles.

As shown in FIG. 10, a pair of bosses 11a are provided at a lower portion on opposite side faces of the male connector 11, respectively and a pair of vertical slits 11b are formed at an upper portion on the opposite side faces of the male connector 11, respectively.

Meanwhile, a slot 11*c* for temporarily retaining a female connector 12 is provided at an upper portion of a rear wall of the male connector 11, while a slit 11*d* is provided at a lower portion of a front wall of the male connector 11. Furthermore, as shown in FIG. 10, a pair of hinge projections 11*e* are, respectively, provided at a lower portion on opposite side faces of the branch joint box 10 disposed below the male connector 11.

Figure 4:
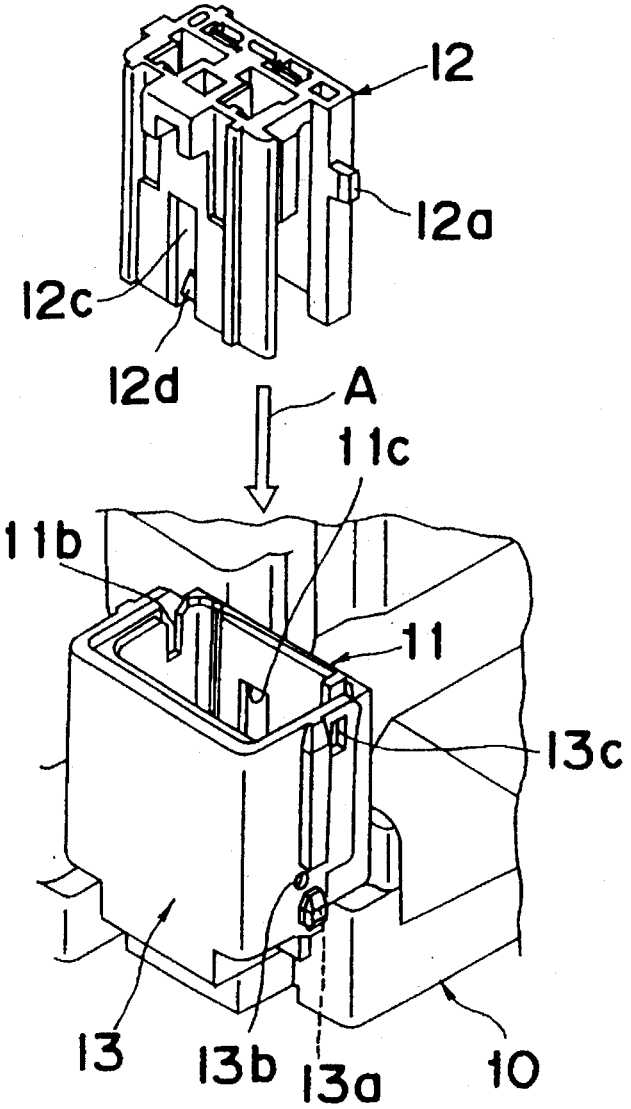
FIGS. 4 and 5 are a perspective view and a side elevational view of a branch joint box according to the present invention prior to fitting of a female connector into a male connector, respectively.
Figure 5:
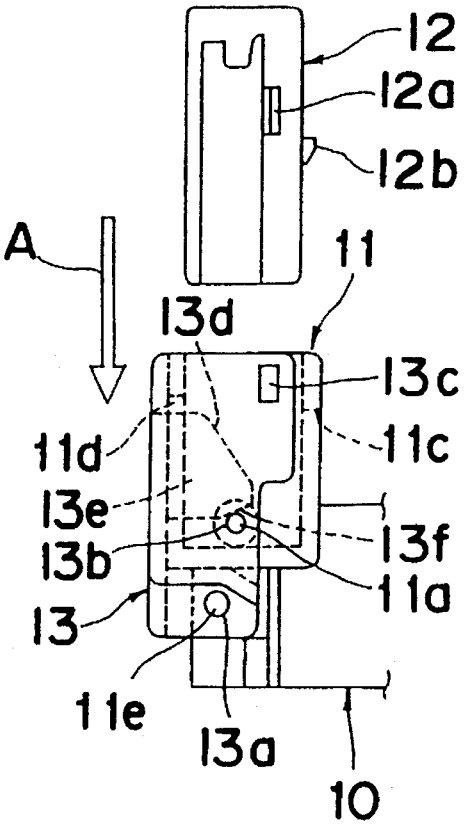

As shown in FIGS. 4 and 5, a pair of lugs 12*a* are provided at an upper portion on opposite side faces of the female connector 12, respectively. When the female connector 12 is fitted into the male connector 11 from above, the lugs 12*a* are brought into engagement with the slits 11*b* of the male connector 11 so as to project outwardly from the opposite side faces of the male connector 11, respectively.

Meanwhile, a boss 12*b* is provided at an upper portion of a rear face of the female connector 12 and is brought into engagement with the slot 11*c* of the male connector 11 when the female connector 12 is fitted into the male connector 11 from above. Meanwhile, a vertical slit 12*c* is provided at a lower portion of a front wall of the female connector 12. A protrusion 12*d* is provided in the slit 12*c* so as no cancel temporary retention of the male connector 11 through the lock cover 13 such that the female connector 12 is brought into full engagement with the male connector 11.

As shown in FIG. 10, a pair of hinge recesses 13*a* are provided at a lower portion of inner faces of opposite side walls of the lock cover 13, respectively so as to be brought into the hinge projections 11*e* of the male connector 11 of the branch joint box 10 from outside such that the inner faces of the opposite side walls are fitted onto the opposite side faces of the male connector 11. When the hinge projections 11*e* are fitted into the hinge recesses 13*a* so as to couple the lock cover 13 with the male connector 11, the lock cover 13 is supported by the male connector 11 so as to be opened and closed between a closed position of FIGS. 4 and 5 and an open position shown in FIGS. 6 and 7.

As shown in FIG. 10, a pair of holes 13*b* are provided at a lower portion of the opposite side walls of the lock cover 13, respectively so as to be brought into engagement with the recesses 11a of the male connector 11 at the above mentioned closed position of the lock cover 13. Meanwhile, a pair of openings 13*c* are, respectively, provided am an upper portion of the opposite side walls of the lock cover 13 so as to be brought into engagement, at the closed position of the lock cover 13, with the lugs 12*a* of the female connector 12 fitted into the male connector 11.

Figure 6:
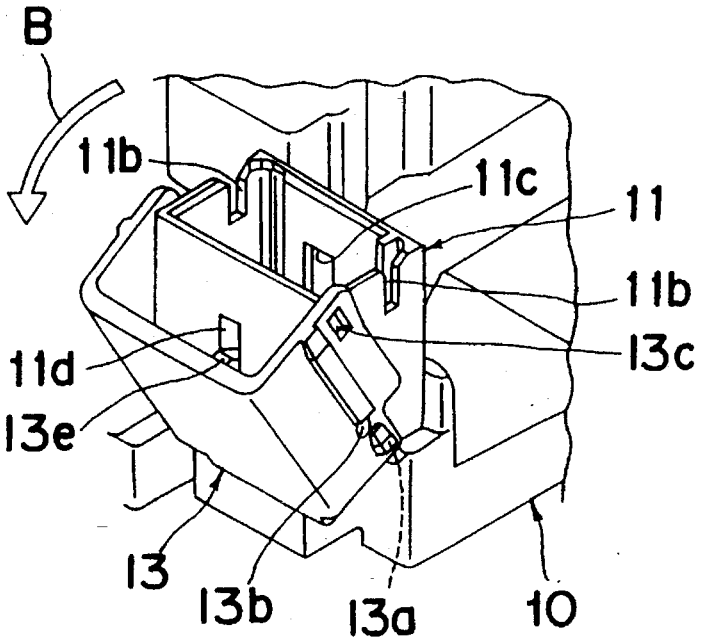
FIGS. 6 and 7 are a perspective view and a side sectional view of the branch joint box of FIG. 4 in the course of fitting of the female connector into the male connector, respectively.
Figure 7:
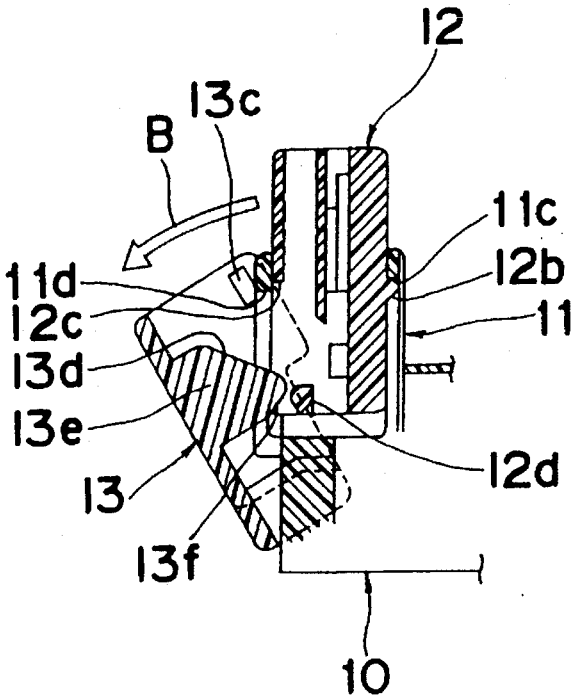

As shown in FIGS. 6 and 7, a projection 13*e* is provided on an inner face of a front wall of the lock cover 13 and has an inclined face 13*d* formed at its upper portion and an inclined face 13*f* formed at its lower portion. At the closed position of the lock cover 13, the projection 13*e* is passed through the slit 11*d* of the male connector 11 so as to project into the male connector 11. If the female connector 12 is fitted into the male connector 11 at this time, the projection 13*e* is depressed by the protrusion 12*d* of the female connector 12 so as to automatically open the lock cover 13 to the open position. On the other hand, when the lock cover 13 is pushed to the closed position, the protrusion 12*d* of the female connector 12 is depressed downwardly by the inclined face 13*f* so as to lock the female connector 12 to the male connector 1.

In the branch joint box 10 of the above described arrangement, the inner faces of the opposite side walls of the lock cover 13 are fitted onto the opposite side faces of the male connector 11 and the hinge recesses 13*a* of the lock cover 13 are, respectively, brought into engagement with the hinge projections 11*e* of the branch joint box 10. Furthermore, the holes 13*b* of the lock cover 13 are, respectively, brought into engagement with the bosses 11*a* of the male connector 11. Thus, as shown in FIGS. 4 and 5, the lock cover 13 is temporarily retained at the closed position and the projection 13*e* of the lock cover 13 extends into the female connector 12 from the slit 12*c*.

When the female connector 12 is fitted into the male connector 11 at an assembly line of motor vehicles in a state where the lock cover 13 is temporarily retained at the closed position as described above, the upper inclined face 13*d* of the projection 13*e* of the lock cover 13 is depressed downwardly by the protrusion 12*d* of the female connector 12 as shown in FIG. 7 and thus, the lock cover 13 is automatically opened to the open position about the hinge recesses 13*a*. On the other hand, the boss 12*b* of the female connector 12 is brought into engagement with the slot 11*c* of the male connector 11, so that the female connector 12 is temporarily retained so as to be disengaged from the male connector 11 in the direction opposite to that for fitting the female connector 12 into the male connector 11.

When the lock cover 13 is pushed to the closed position as shown by the arrow C in FIGS. 8 and 9 after the female connector 12 has been inserted into the male connector 11 up to a predetermined position, the lower inclined face 13*f* of the projection 13*e* of the lock cover 13 depresses the protrusion 12*d* of the female connector 12 downwardly. As a result, not only the female connector 12 is completely fitted into the male connector 11 but the female connector 12 is locked to the male connector 11 at the fitting position by the projection 13*e* of the lock cover 13.

Meanwhile, even if an operator tries to push the lock cover 13 to the closed position when the female connector 12 is fitted into the male connector 11 insufficiently, the protrusion 12*d* of the female connector 12 cannot be depressed downwardly by the lower inclined face 13*f* of the projection 13*e*, namely, the lock cover 13 cannot be closed to the closed position, which enables detection of insufficient fitting of the female connector 12 into the male connector 11.

Furthermore, when the lock cover 13 has reached the closed position, the lugs 12*a* of the female connector 12 are, respectively, brought into engagement with the openings 13*c* of the lock cover 13 so as to lock the female connector 12 to the male connector 11 at the fitting position. Therefore, in order to lock the female connector 12 to the male connector 11, the lugs 12*a* of the female connector 12 and the openings 13*c* of the lock cover 13 are provided as a double locking member in addition to the projection 13*e* of the lock cover 13. When the lugs 12*a* of the female connector 12 are, respectively, brought into engagement with the openings 13*c* of the lock cover 13 through the slits 11*b* of the male connector 11, the lock cover 13 is securely mounted on the male connector 11, i.e., the branch joint box 10.

Since the female connector 12 can be fitted into the male connector 11 regardless of whether the lock cover 13 is disposed at the open position or the closed position as described above, working efficiency for fitting the female connector 12 into the male connector 11 rises. Meanwhile, since it is not necessary to hold the lock cover 13 at the open position until the female connector 12 is fitted into the male connector 11, a hitherto required dummy cover connector becomes unnecessary. As a result, the number of components is lessened and the number of control steps of the components is also reduced. Furthermore, an operation that the dummy cover connector is drawn out of the male connector 11 is not required to be performed, thereby resulting in further improvement of working efficiency for fitting the female connector 12 into the male connector 11.

Meanwhile, if the lock cover 13 is closed by fitting into the male connector 11 a cover connector similar to a conventional one in place of the female connector 12, the branch joint box can be used in common for a circuit utilizing a circuit portion of the male connector 11 and another circuit which does not utilize the circuit portion of the male connector 11.

As is clear from the foregoing description of the branch joint box of the present invention, during transport, etc. of the branch joint box prior to mounting of the branch joint box on a motor vehicle, the lock cover is temporarily retained at the closed position by the temporary retention portions. Meanwhile, when the female connector is fitted into the male connector at the time of mounting of the branch joint box on the motor vehicle, temporary retention of the lock cover is cancelled by the temporary retention cancelling portion such that the lock cover is automatically opened to the open position. Subsequently, when the lock cover is pushed to the closed position, the female connector is locked to the male connector at the fitting position by the locking portion of the lock cover and the lock cover can be held at the closed position relative to the branch joint box.

Accordingly, since the female connector can be fitted into the male connector regardless of whether the lock cover is disposed at the closed position or the open position, working efficiency for fitting the female connector into the male connector rises. Meanwhile, since a hitherto required dummy cover connector becomes unnecessary, the number of components is lessened and the number of control steps of the components is also reduced. Furthermore, since an operation that the cover connector is drawn out of the male connector is not required to be performed, working efficiency for fitting the female connector into the male connector is further improved.

What is claimed is:

1. A branch joint box in which after a female connector connected to a wiring harness has been fitted into a male connector provided on the branch joint box, a lock cover provided on the branch joint box is closed and the female connector is locked to the male connector at a fitting position of the female connector by a locking portion of the lock cover, the branch joint box comprising:

a temporary retention means for temporarily retaining the lock cover to the branch joint box at a closed position of the lock cover prior to fitting of the female connector into the male connector;

a temporary retention cancelling means for cancelling temporary retention of the lock cover in response to movement of the female connector into the male connector so as to move the lock cover to an open position of the lock cover, whereby, when the lock cover is closed, the temporary retention cancelling means also moves the female connector away from the male connector when the female connector is more than a predetermined distance from the fitting position, and moves the female connector to the fitting position when the female connector is less than the predetermined distance from the fitting position; and a fixed retention means which, after the female connector has been fitted into the male connector, at the fitting position, locks the female connector to the male connector and locks the lock cover to the branch joint box.

2. The branch joint box according to claim 1, wherein the temporary retention cancelling means includes a first surface on the lock cover for contacting an element on the female connector to move the lock cover to the open position.

3. The branch joint box according to claim 2, wherein the temporary retention cancelling means includes a second surface for contacting the element of the female connector for moving the female connector to the fitting position.

4. The branch joint box according to claim 1, wherein the fixed retention means includes a lug on the female connector for engagement with a slit on the male connector and an opening on the lock cover.

* * * * *